US005593510A

United States Patent [19]

Tahara et al.

[11] Patent Number: 5,593,510

[45] Date of Patent: Jan. 14, 1997

[54] METHOD OF CARBURIZING AUSTENITIC METAL

[75] Inventors: Masaaki Tahara, Takatsuki; Haruo Senbokuya, Tondabayashi; Kenzo Kitano, Kawachinagano; Tadashi Hayashida, Sakai, all of Japan

[73] Assignee: Daido Hoxan, Inc., Hokkaido, Japan

[21] Appl. No.: 423,644

[22] Filed: Apr. 17, 1995

[30] Foreign Application Priority Data

Apr. 18, 1994 [JP] Japan ..... 6-078677
Sep. 30, 1994 [JP] Japan ..... 6-237057

[51] Int. Cl.[6] ..... C23C 8/22

[52] U.S. Cl. ..... 148/225; 148/206

[58] Field of Search ..... 148/206, 225, 148/316, 319

[56] References Cited

U.S. PATENT DOCUMENTS 3,765,929 10/1973 Martin .
3,827,923 8/1974 Harvey et al. ..... 148/319
5,252,145 10/1993 Tahara et al. ..... 148/206
5,340,412 8/1994 Yoshino et al. ..... 148/208
5,424,028 6/1995 Maloney et al. ..... 148/319

FOREIGN PATENT DOCUMENTS

0408168A1 1/1991 European Pat. Off. .
59-013065 1/1984 Japan .
60-067651 8/1985 Japan .
361345 3/1991 Japan ..... 148/316
405163563 6/1993 Japan ..... 148/319

*Primary Examiner*—Deborah Yee
*Attorney, Agent, or Firm*—Armstrong, Westerman, Hattori, McLeland & Naughton

[57] ABSTRACT

A method of carburizing austenitic metal comprising the steps of holding austenitic metal in a fluoride-containing gas atmosphere with heating prior to carburizing and carburizing the austenitic metal at a temperature not more than 680° C. and austenitic metal products obtained thereby.

8 Claims, 5 Drawing Sheets

METHOD OF CARBURIZING AUSTENITIC METAL

FIELD OF THE INVENTION

This invention relates to a method of carburizing austenitic metal for hardening its surface and austenitic metal products obtained thereby.

BACKGROUND OF THE INVENTION

Stainless steel, especially austenitic stainless steel, has been widely employed for its superior corrosion resistance property and its capability of being decorated. Particularly, fasteners such as a bolt, a nut, a screw, a washer and a pin are made of austenitic stainless steel in view of these properties. However, strength itself of the above austenitic stainless steel products differs from that of carbon steel so that the strength of the above products is improved mostly in an intermediate processing step before a final step to make each figure thereof. For example, crystal structure of the austenitic stainless steel is closely tightened by press working, extrusion molding, panting and the like so as to strengthen the material itself. Such improvement of the strength in the intermediate processing step is necessarily limited because there are restrictions to shape the material into a specific figure by the figure such as a bolt or a nut and also to lower cost of a mold in the extrusion molding and the like. Therefore, when higher strength, anti-seizure, a tapping capacity on a steel plate are demanded on austenitic stainless steel products such as a bolt, a nut and a screw, the following methods are available. ① Hard chrome plating or wet type metal plating such as Ni—P, ② coating such as physical vapor deposition, abbreviated to PVP hereinafter, or ③ hardening treatment by penetration such as nitriding or the like.

However, the above methods such as the wet type metal plating or the coating like PVD have drawbacks of shortening product lifetime due to peeling of a coat formed on the surface of the austenitic stainless steel products and the like.

Further, the above nitriding comprises penetrating nitrogen atoms from the surface of austenitic stainless steel inside thereof so as to form the surface lawyer into a hard nitrided one. In this method, the surface hardness of austenitic stainless steel products is improved, however, a vital problem of deteriorating an essential property of anti-corrosion is caused. Furthermore, there are other drawbacks that the surface roughness of the products deteriorates, the surface blisters or the products are magnetized. It is thought that nitriding deteriorates anti-corrosion property because chrome atoms (which improve anti-corrosion property) contained in the austenitic stainless steel are consumed as chrome nitrides such as CrN and $Cr_3N$ by nitriding and their content lowers. Still further, there are problems that the surface blisters, the surface roughness deteriorates or the like.

As the other methods for the above penetration treatment for hardening, there is carburizing. However, a conventional carburizing method comprises contacting the surface of austenitic stainless steel products with a gas containing carbon so as to invade the carbon atoms into the surface layer and to form a hard carburized layer. In this method, carburizing is generally conducted at a temperature not less than 700° C. of an A1transformation temperature of iron by considering the permeability of carbon atoms and a limit of solid solution. This means that the austenitic stainless steel products have been maintained at a temperature far beyond the recrystallization (N.B. a temperature of recrystallization of iron is about 450° C.) for a long time, resulting in remarkable deterioration of the strength, which is a great drawback. Since this carburizing method has the drawback that the material strength itself deteriorates greatly, its application to austenitic stainless steel products, which do not have originally so much hardness, is not being taken into consideration. In addition, it is true that an improvement of strength on fasteners such as a bolt, a nut or a screw is realized by press working, extrusion molding or panting as mentioned above to improve the entire hardness, so that an application of a technique to improve only the surface by carburizing is not considered.

OBJECT OF THE INVENTION

Accordingly it is an object of the invention to provide a method of carburizing austenitic metal to improve the surface hardness drastically without deteriorating the strength originated from the austenitic metal base material, moreover without deteriorating superior corrosion resistance originated from the austenitic metal base material, too, and to provide austenitic metal products obtained thereby.

DISCLOSURE OF THE INVENTION

To accomplish the above object, the invention provides in a first gist a method of carburizing austenitic metal comprising maintaining the austenitic metal under fluoride-containing gas atmosphere with heating prior to carburizing and then carburizing the austenitic metal by setting up a temperature of the carburizing at not more than 680° C. Secondly, the invention provides in a second gist the austenitic metal products obtained by the above method wherein a surface layer in depth of 10 to 70 μm is hardened by invasion of carbon atoms so as to be formed into a carburized hard layer whose hardness is 700 to 1,050 Hv of Micro Vickers Hardness and not having rough chromium carbide grains.

During a series of studies to improve a technology for better surface hardness of austenitic metal, we came up with an idea that carburizing austenitic metal such as austenitic stainless steel becomes possible at a temperature not more than an A1 transformation temperature of steel if pretreatment with fluoride-containing gas is conducted before carburizing. During a process based upon this idea, we found out that carburizing becomes possible, which has been regarded as impossible heretofore, if the austenitic metal is treated with fluoride-containing gas prior to carburizing or at the same time as carburizing. Especially, we also found out that more effective carburizing can be realized at not more than 680° C., preferably not more than 500° C., instead of not less than 700° C. employed heretofore, whereby the surface layer in depth of 10 to 70 μm from the surface of austenitic metal products such as austenitic stainless steel products is formed into a carburizing surface having 520 to 1,180 Hv of Micro Vickers Hardness, preferably 700 to 1050 Hv, in which rough chromium carbide grains are not deposited, resulting in the invention. Thus obtained carburized products have a hard surface layer and also maintain substantially corrosion resistance property originated from austenitic metal itself. In addition, there are substantially no problems such as the surface blistering, deterioration of the surface roughness, or the like.

The size of the rough chromium carbide grains usually falls in 0.1 to 5 μm. However, even if rough carbide grains in minuter size are contained in the carburized layer, there are no problems to realize the effects such as improvement on the surface hardness. Further, when the carbon concentration of the carburized layer is set at 2.0% by weight or so as the upper limit, the effect of hardening the surface increases drastically. Furthermore, when austenitic metal such as stable austenitic stainless steel containing 32% by weight nickel or 1.5% by weight molybdenum is adopted as the material of the austenitic metal such as austenitic stainless steel for forming austenitic metal products, the effect of decreasing the deterioration of corrosion resistance can be obtained.

The present invention is now described in further detail.

In the present invention, austenitic metal is carburized after pre-treatment with fluoride-containing gas or at the same time of the pre-treatment.

As the above austenitic metal, there is austenitic stainless steel containing iron not less than 50% by weight (hereinafter abbreviated to wt %) and chrome not less than 10 wt % or the like. Specifically, they are 18-8 stainless steel such as SUS316 and SUS304, or SUS310 or SUS309, austenitic stainless steel containing 23 wt % chrome and 13 wt % nickel, or further two-phase austenite-ferrite stainless steel containing 23 wt % chrome and 2 wt % molybdenum and the like. Furthermore, incoloy (Ni: 30 to 45 wt %, Cr: not less than 10 wt %, the remainder: Fe and the like), which is heat resisting steel, is included. Besides, the above austenitic steel includes nickel base alloy containing nickel not less than 45 wt %, 20 wt % chrome, 30 wt % iron plus molybdenum or the like as the remainder. Thus, austenitic metal is defined in this invention as all metal showing austenitic phase substantially at an ordinary temperature, which means that austenitic phase accounts for not less than 60 wt %. Therefore, austenitic metal here contains Fe-Cr-Mn metals, which substitute Ni with Mn, an austenitic stable element. In the invention, these are called the base material.

Among austenitic metals formed from the austenitic metal material, especially, austenitic stainless steel is employed often for fasteners such as a bolt, a nut, a screw, a washer and a pin. In the invention, austenitic metal products such as austenitic stainless steel products contain a variety of stainless steel products such as a chain, a case for a watch, an edge of a spinning spindle, a minute gear and a knife in addition to the above fasteners.

Prior to or at the same time as carburizing, fluorinating treatment is conducted under a fluoride-containing gas atmosphere. Fluoride-containing gas is employed for this fluorinating treatment. As the above fluoride-containing gas, there are fluoride compound comprising $NF_3$, $BF_3$, $CF_4$, HF, $SF_6$, $C_2F_6$, $WF_6$, $CHF_3$, $SIF_4$, $ClF_3$, and the like. These are employed solely or in combination. Besides, fluorine compound gas with F in its molecule can be used as the above-mentioned fluoride-containing gas. Also $F_3$ gas formed by cracking fluorine compound gas in a heat decomposition device and preliminarily formed $F_2$ gas are employed as the above-mentioned fluoride-containing gas. According to the case, such fluorine compound gas and $F_2$ gas are mixed for the use. The above-mentioned fluoride-containing gas such as the fluorine compound gas and $F_2$ gas can be used independently, but generally are diluted by inert gas such as $N_2$ gas for the treatment. The concentration of fluoride-containing gas itself in such diluted gas should amount to, for example, 10,000 to 100,000 ppm, preferably 20,000 to 70,000 ppm, more preferably 30,000 to 50,000 ppm by capacity. In the light of practicability, $NF_3$ is the best among the above compound gases. This is because $NF_3$ has chemical stability and is easy to treat since it is in the state of a gas at an ordinary temperature. Such $NF_3$ gas is usually employed in combination with the above $N_2$ gas within the above concentration range.

In the invention, first of all, the above-mentioned non-nitrided austenitic metal is held in a furnace under a heated condition in a fluoride-containing gas atmosphere within the above concentration range, and then fluorinated. In this case, the austenitic metal is held with heating at the temperature of, for example, 250° to 600° C., preferably 280° to 450° C. The holding time of the above-mentioned austenitic metal may be generally within the range of ten or so minutes or dozens of minutes. The passive coat layer, which contains $Cr_2O_2$, formed on the surface of the austenitic metal, is converted to a fluorinated layer. Compared with the passive coat layer, this fluorinated layer is thought to be readily penetrated with carbon atoms employed for carburizing. That is, the austenitic metal surface is formed to the suitable condition for penetration of "C" atoms by the above-mentioned fluorination.

Then, carburizing is conducted after the fluorination treatment like the above. In the carburizing, the above austenitic metal itself is heated at not more than 680° C., preferably not more than 600° C., more preferably between 400° and 500° C. under a carburizing gas atmosphere, comprising $CO_2$ and $H_2$, or comprising RX [RX components: 23% by volume CO (as abbreviated to vol % hereinafter), 1 vol % $CO_2$, 31 vol % $H_2$, 1 vol % $H_2O$, the reminder $N_2$] and $CO_2$ in a furnace. Thus, the greatest characteristic in this invention is a low carburizing temperature in which the core part of the austenitic metal may not be softened and solubilized. In this case, the ratio of $CO_2$ and $H_2$ is preferably 2 to 10 vol % for $CO_2$ and 30 to 40 vol % for $H_2$ and the ratio of RX and $CO_2$ is preferably 80 to 90 vol % for RX and 3 to 7 vol % for $CO_2$. Besides, a gas mixture of CO, $CO_2$ and $H_2$ is employed for carburizing. In this case, ratios of 32 to 43 vol % for CO, 2 to 3 vol % for $CO_2$ and 55 to 65 vol % for $H_2$ is preferable.

By this treatment, "carbon" diffuses and penetrates into the surface of austenitic metal so as to form a deep uniform layer. Such a layer realizes drastic improvement in hardness compared with the base material and also retains anti-corrosion property as same as that of the base material, because the layer is in a form wherein γ-phase as a base phase is greatly distorted due to solution of a great amount of "C". For example, an SUS316 plate, a typical austenitic stainless steel, is carburized as follows. First the SUS316 plate was introduced into a furnace and was fluorinated at 300° C. for 40 minutes under a fluoride-containing gas atmosphere of $NF_3$ and $N_2$ ($NF_3$: 10 vol %, $N_2$: 90 vol %). After exhausting the above fluoride-containing gas, a carburizing gas of CO, $CO_2$ and $H_3$ (32 vol % CO, 3 vol % $CO_2$ and 65 vol % $H_3$) was introduced into the furnace so that the SUS316 plate was kept at 450° C. in the furnace for 16 hours. As a result, a hard layer having a surface hardness of Hv of 880 (NB. the core part is Hv of 230 to 240) and a thickness of 20 μm was formed. When this sample was put to the salt spray test (abbreviated to SST hereinafter) according to JIS2371, it did not rust at all over 480 hours. Further, the hard layer was not etched by Billrer reagent (acidic picric acid alcohol solution), which is employed for an anti-corrosion test of a hard layer, and was barely etched by agua regia. Furthermore, the surface roughness hardly deteriorated, and dimension change by blister and magnetism did not occur in the above sample. As a result of further studies by varying the combination of a various kinds of austenitic metal plates, carburizing temperatures and the like, it was found out that the core of austenitic metal easily softens and also anti-corrosion property deteriorates when a carburizing temperature is over 600° C. It was found out that from a viewpoint of anti-corrosion property, a carburizing temperature is preferably not more than 600° C., more preferably not more than 500° C., which brings about a good result. As mentioned above, a more preferable carburizing temperature is 400° to 500° C. In addition, it was clarified that among austenitic metal, a stable austenitic stainless steel having molybdenum and nickel as much as possible shows a good anti-corrosion property after being hardened.

The above-mentioned fluorinating and carburizing steps are, for example, taken in a metallic muffle furnace as shown in FIG. 1, that is, the fluoriding treatment is carried out first at the inside of the muffle furnace, and then the carburizing treatment is put in practice. In FIG. 1, the reference numeral 1 is a muffle furnace, 2 an outer shell of the muffle furnace, 3 a heater, 4 an inner vessel, 5 a gas inlet pipe, 6 an exhaust pipe, 7 a motor, 8 a fan, 11 a metallic container, 13 a vacuum pump, 14 a noxious substance eliminator, 15 and 16 cylinders, 17 flow meters, and 18 a valve. An austenitic stainless steel product 10 is put in the furnace 1 and fluorinated with heating by introducing fluoride-containing gas such as $NF_3$ from cylinder 16, connected with a duct. The gas is led into the exhaust pipe 6 by the action of the vacuum pump 13 and detoxicated in the noxious substance eliminator 14 before being spouted out. And then, the cylinder 15 is connected with the duct to carry out carburizing by introducing the carburizing gas into the furnace 1. Finally, the gas is spouted out via the exhaust pipe 6 and the noxious substance eliminator 14. Through the series of these operations, fluoriding and carburizing treatments are put in practice.

Thus, according to the carburizing of this invention, the articles with such a treatment retain excellent anti-corrosion property, which is thought to be due to the following reason. Since fluorinating treatment is conducted prior to carburizing, a low carburizing temperature of not more than 680° C. can be realized. By this carburizing at a low temperature, chrome element, which is thought to work for improving anti-corrosion property in the austenitic metal is difficult to precipitate and fix as carbide such as $Cr_7C_2$, $Cr_{23}C_6$ or the like and then the volume of fixed precipitation lowers, whereby much chrome element remains in the austenitic metal. This is clear by comparing FIG. 3 and FIG. 2(*b*) with FIG. 2(*a*). FIG. 3 shows an x-ray diffraction result for an SUS316 article, which was fluorinated under fluoride-containing gas of 10 vol % $NF_3$ and 90 vol % $N_2$ at 300° C. for 40 minutes and then carburized under a carburizing gas of 32 vol % CO, 3 vol % $CO_2$ and 65 vol % $H_2$ at 600° C. for 4 hours. FIG. 2(*b*) shows an x-ray diffraction result for an SUS316 article, which was fluorinated in the same way and carburized at 450° C. for 16 hours. On the other hand, FIG. 2(*a*) shows an x-ray diffraction result for an SUS316 article, which was untreated. That is, a peak of $Cr_{23}C_6$ is sharp and high in carburizing at 600° C. in FIG. 3. This means that the above carbide precipitates relatively much while less chrome element remains in austenitic metal. On the other hand, a peak of $Cr_{23}C_6$ can hardly identified in carburizing at 450° C. in FIG. 2(*b*). This means that the precipitation of the above chromium carbide is extremely low while more chrome element remains in austenitic metal, resulting in high anti-corrosion property.

Furthermore, an improvement in hardness of carburized articles is thought to be attributed to occurrence of γ-lattice distortion by penetration of carbon atoms. It is clear that γ-lattice distortion is caused in a carburized article in FIGS. 2(*b*) and (*c*), because each γ-phase peak position of a carburized article at 450° C. [FIG. 2(*b*)] and a carburized and acid-treated article at 480° C. [FIG. 2(*c*)] according to an x-ray diffraction shift to low angle side (left side) from that of untreated SUS316 article. In addition, the above x-ray diffraction was conducted by RINT1500 device at 50 KV, 200 mA and Cu target.

In the present invention, when a carburizing temperature increases, especially surpasses 450° C., a phenomenon that carbide such as $Cr_{23}C_6$ precipitates on the surface of the hard layer although it is a very small amount. However, even in this case, if a carburized article is soaked into strong acid such as HF-$HNO_3$, HCL-$HNO_3$ or the like to remove the above precipitation, anti-corrosion property as same level as the base material and also excellent surface hardness not less than Hv of 850 in rickets hardness can be retained. FIG. 2(*c*) shows an x-ray diffraction chart of an SUS316 article shown in FIG. 2(*a*) which is carburized at 480° C. and then soaked into strong acid of 5 vol % HF and 15 vol % $HNO_3$ concentration for 20 minutes, wherein no carbide was observed. In thus carburized austenitic metal, for example austenitic stainless steel products, the carburized hard layer formed on the surface becomes black due to carburizing and the outermost layer becomes iron inner oxide layer, according to a case. That is, the inner oxide layer on the surface is formed by presence of oxygen atoms, which sometimes exist in the carburizing atmosphere. The removal of the inner oxide layer, as mentioned before, can be conducted by soaking into strong acid such as HF-$HNO_3$ and HCL-$HNO_3$ so as to remove the above deposit. Thereby, corrosion resistance as the same level as that of base material and high surface hardness not less than 850 Hv of Vickers hardness can be maintained. Austenitic stainless steel products wherein the inner oxide layer is removed by the above treatment turn to show glossiness as the same as that before being carburized. In detail, a layer which is dark color exists in depth of 2 to 3 μm from the surface in the outermost layer was found out by examining the surface of carburized products, which was identified as an iron inner oxide layer by an x-ray diffraction method. This means that carburizing ($CO \rightarrow CO_2 + C$) and oxidation of Fe ($4CO_2 + 3Fe \rightarrow 4CO + Fe_3O_4$) coexist at the same time under the atmosphere containing CO at a temperature between 400° and 500° C. so that the above inner oxide layer was formed. Such an iron inner oxide layer cannot be seen in conventional carburizing methods at not lees than 700° C. Further, in detail, a socket bolt and a washer of SUS316L (C=0.02 wt %, Cr=17.5 wt %, Ni=12.0 wt % and Mo=2.0 wt %) which were carburized at 480° C. for 12 hours, the hard layer depth was 30 μm and the surface hardness showed 910 Hv of Micro Vickers Hardness. Consecutively, these black colored carburized articles were soaked into solution of 5 wt %HF-25 wt %$HNO_3$, heated to 50° C. for 20 minutes and then conducted with soft blast so that a socket bolt and a washer, which show glossy appearance as the same as those before being carburized, could be obtained. These are subjected to JIS 2371 Salt Spray Test so that no rusts were caused in 2,000 hours. Further, results of a pitting corrosion test by JIS 0578 using ferric chloride were substantially the same as those of untreated SUS316.

In addition, the diffusion speed of C in austenitic organization is relatively slow in case of a low temperature region not more than 500° C., the above carburized hard layer on SUS316L series, in which a hard layer becomes the thickest, becomes 37 μm with treatment at 490° C. for 12 hours and becomes only 49 μm with additional treatment for another 12 hours. To obtain a hard layer in 70 μm depth, it takes not less than 70 hours. Such long-time treatment is not economical. Even in drill tapping, which, requires a hard layer as thick as possible, it is possible to drill SPCC (Steel Plate Cold Coiled) of 2.3t with a hard layer in 40 μm depth, whereby a useful hard layer can be obtained in suitable time with economical efficiency.

EFFECT OF THE INVENTION

As mentioned hereinbefore, carburizing austenitic metal according to the invention realizes a low carburizing temperature not more than 680° C. because the austenitic metal is kept being heated under fluoride-containing gas atmosphere prior to or at the same time as carburizing. Therefore, high surface hardness can be realized without deteriorating anti-corrosion property and high processability inherent in austenitic metal itself. In addition, since the surface hardness is improved thanks to the above carburizing, any inconveniences such as surface roughness caused by nitriding, dimension inaccuracy by blister and magnetization in austenitic metal itself are not occurred at all.

Thus obtained austenitic metal products such as austenitic stainless steel products have a hard layer in depth of 10 to 70 μm which is formed into a carburized layer by invasion of carbon atoms of 520 to 1,180 Hv Micro Vickers Hardness, preferably 700 to 1,050 Hv. Further, since rough chromium carbide grains are not deposited in the carburized hard layer, the obtained products have corrosion resistance originated from austenitic metal itself and also have high surface hardness. Therefore, among austenitic metal products, fasteners such as a bolt, a nut and a screw made of austenitic stainless steel, which have excellent properties such as strength in fastening, anti-seizure and tapping toward steel plates, are especially useful for such an application that requires decorativeness and durability at the same time, for example, fasteners for an automobile's interior and exterior.

The following examples and comparative examples are further illustrative of the invention.

EXAMPLE 1 AND COMPARATIVE EXAMPLE 1

Each plank in 2.5 mm thick of SUS316 (Cr: 18 wt %, Ni: 12 wt %, MO: 2.5 wt %, Fe: the remainder) and SUS304 (Cr: 18 wt %, Ni: 8.5 wt %, Fe: the remainder) was prepared as examples. Further, a plank in 1 mm thick of NCF601 (Ni: 60 wt %, Cr: 23 wt %, Fe: 14 wt %), nickel base material, was prepared. As comparative examples, each plank in 2.5 mm of SUS430 of ferrite stainless steel (C: 0.06 wt %, Cr: 17.5 wt %, Fe: the remainder), and SUS420$J_2$ of martensitic stainless steel (C: 0.32 wt %, Cr: 13 wt %, Fe: the remainder) was prepared.

Figure 1:
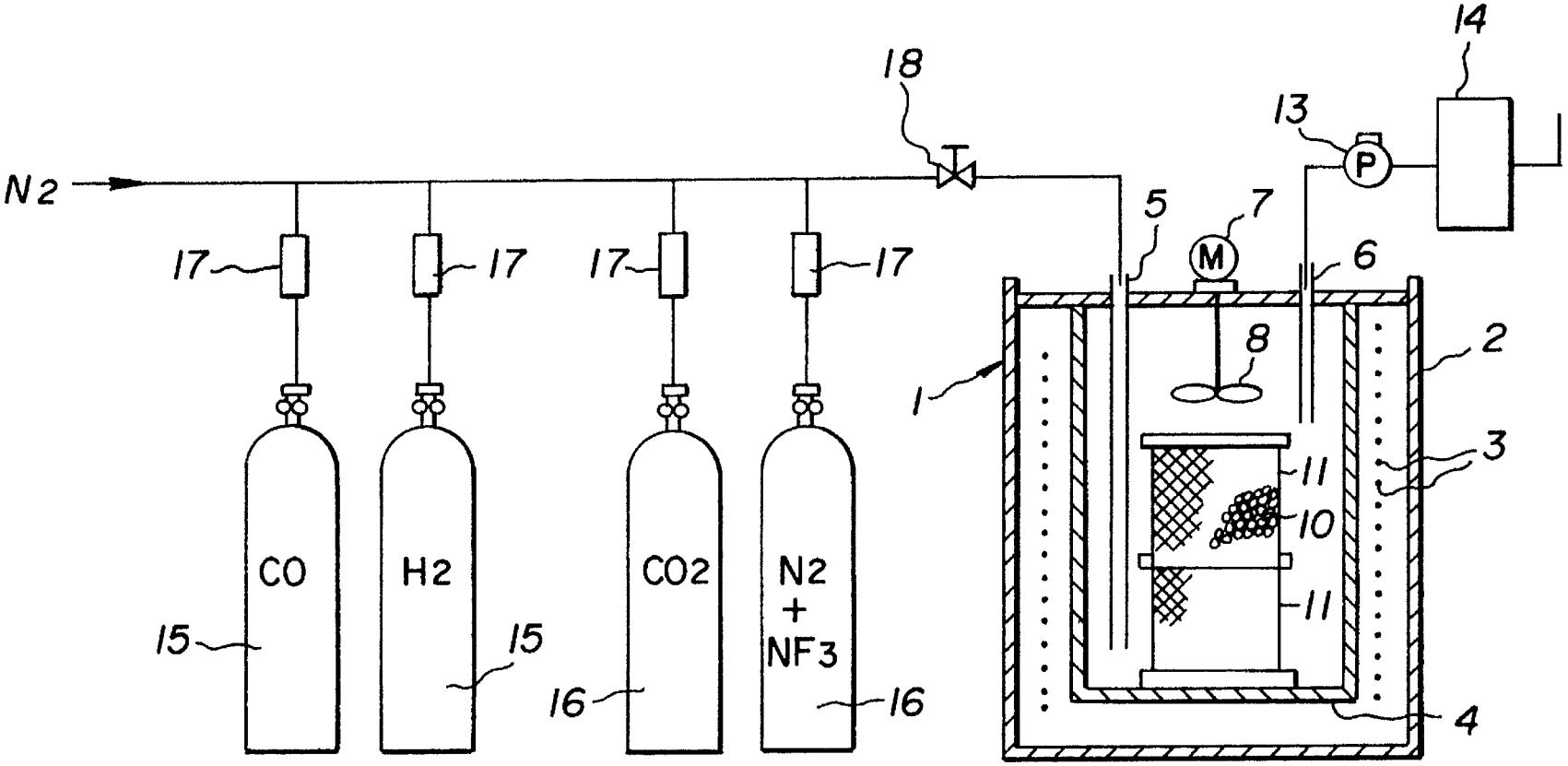
FIG. 1 schematically shows a construction of a furnace for carrying out carburizing according to the invention, FIG. 2(*a*) shows a curve of x-ray diffraction on an untreated SUS316 article, (b) shows a curve of x-ray diffraction on a carburized SUS316 plate at 450° C. and (c) shows a curve of x-ray diffraction on an SUS316 plate, which was carburized at 480° C. and treated with strong acid.

Next, these materials were charged into a muffle furnace 1 as shown in FIG. 1. The inside of the muffle furnace 1 was vacuum-purged and heated to 300° C. Then, in that state, fluoride containing gas ($NF_3$ 10 vol %+$N_2$ 90 vol %) was introduced into the muffle furnace 1 to form an atmospheric pressure therein and such a condition was maintained for 10 minutes for fluorination. Then after exhausting the above-mentioned fluoride-containing gas out of the furnace 1, the inside of the furnace was heated up to 450° C. and, in that state, carburizing gas (CO: 10 vol %, $CO_2$: 2 vol %, $H_2$: 10 vol %, $N_2$: the remainder) was introduced into the furnace 1 and kept for 16 hours for carburizing.

The surface of samples obtained from examples (SUS316, SUS304 and NCF601) became black. The surface of samples obtained from comparative examples did not become black. Next, the above black layer on the surface of examples was rubbed out and then surface hardness and thickness of the hard layer were measured. In addition, the same measurement was conducted on comparative examples for comparison. The results are shown in the following table 1.

TABLE 1

| | SURFACE HARDNESS (Hv) (CORE HARDNESS) | THICKNESS OF A HARD LAYER (μm) |
|---|---|---|
| EXAMPLES | | |
| SUS316 | 870 to 890 (230 to 240) | 20 |
| SUS304 | 900 to 920 (320 to 350) | 22 |
| NCF601 | 720 to 730 (300 to 320) | 12 |
| COMPARATIVE EXAMPLES | | |
| SUS430 | 190 to 210 (190 to 210) | None |
| SUS420$J_2$ | 190 to 210 (190 to 210) | None |

Figure 4:
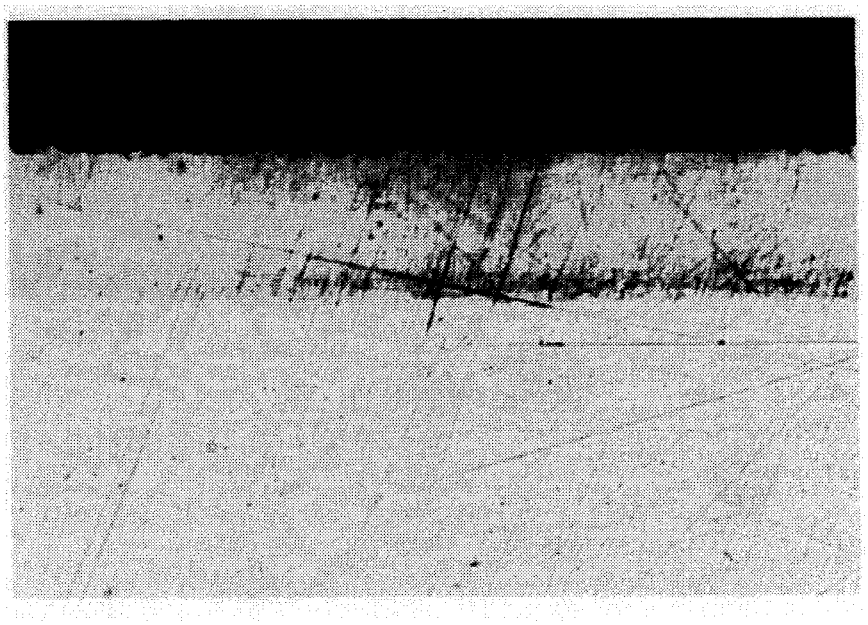
FIG. 4 shows a sectional microphotograph of an SUS316 plate which was carburized at 450° C.
Figure 5:
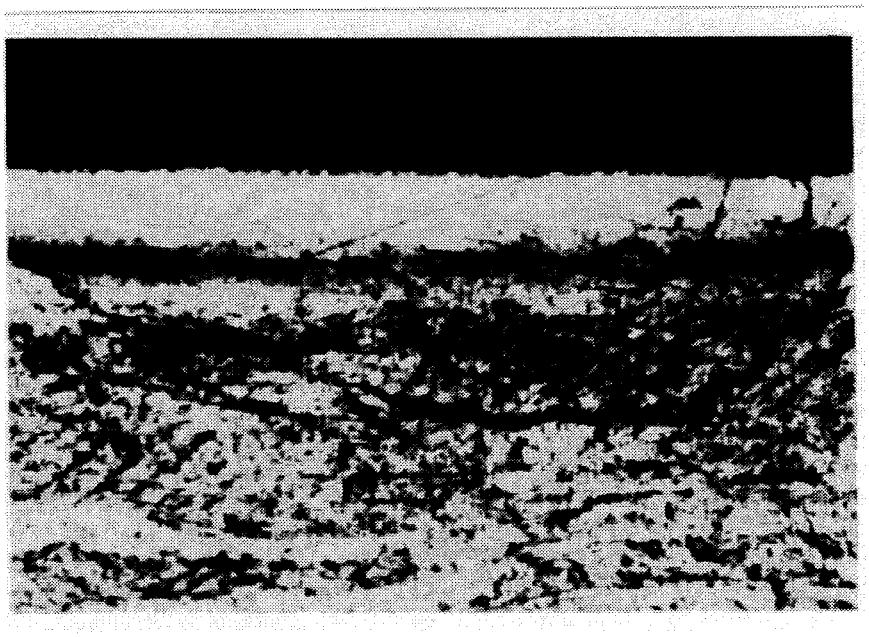
FIG. 5 shows a sectional microphotograph of an SUS304 plate which was carburized at 450° C.
Figure 6:
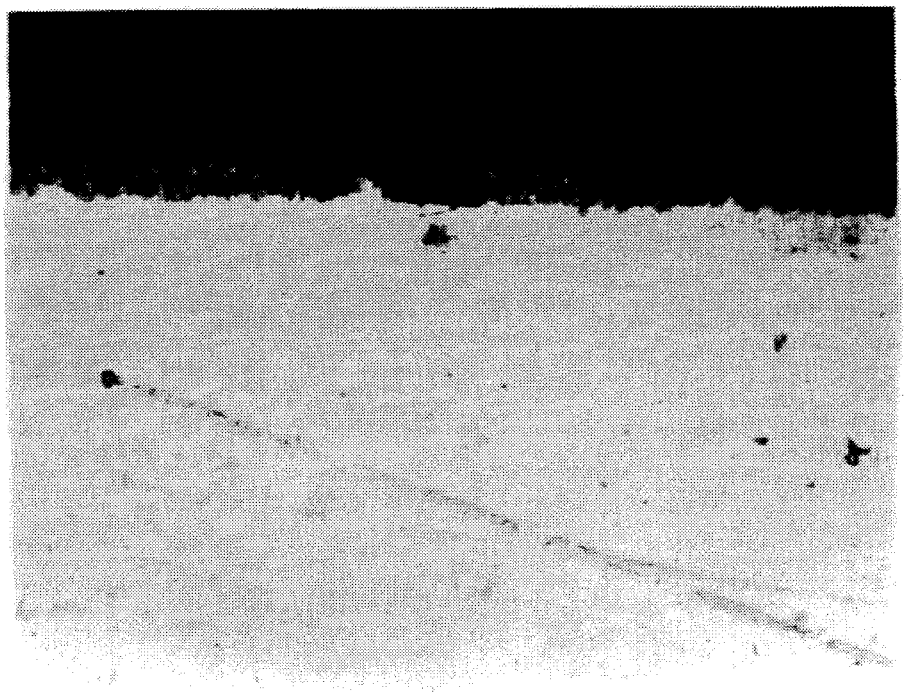
FIG. 6 shows a sectional microphotograph of an NCF601 plate which was carburized at 450° C.

As clear from the above results, the, surface hardness of every example was drastically improved by carburizing, wherein a hard layer was formed, while such phenomenon could not be seen in comparative examples at all. Furthermore, each sectional microphotograph of the examples SUS316, SUS304 and NCF601 were shown respectively in FIG. 4, FIG. 5 and FIG. 6. These photographs were taken at ×600 magnification by an optical microscope. In these figures, from the bottom, a base layer, a carburized hard layer and a resin layer (a black part) were shown. In addition, the above resin layer comprises resin wherein a sample is embedded therein.

Next, the above examples were polished by emery paper, and were subjected to another kind of an anti-corrosion test by a salt spray test according to JIS 2371 and soaking into 15 wt %$HNO_3$ of 50° C., and also each magnetic permeability was measured. The results for untreated SUS316, SUS304 and NCF601 articles, and also their nitrided articles were shown in Table 2.

TABLE 2

| | SUS316 | SUS304 | NCF601 |
|---|---|---|---|
| Time to rust by SST | | | |
| Untreated | not less than 480h | not less than 480h | not less than 480h |
| Nitrided at 580° C. | 1.5h | 1.5h | not less than 480h |
| Example 1 | not less than 480h | 24h | not less than 480h |
| $HNO_3$ soaking 50° C. 15% | | | |
| Nitrided at 580° C. | $H_2$ bubble occurred | $H_2$ bubble occurred | Black surface |
| Example 1 | No change | No change | No change |
| Magnetic permeability (μ) | | | |
| Untreated | 1.002 | — | — |
| Nitrided at 580° C. | 1.251 | — | — |
| Example 1 | 1.002 | — | — |
| Plank blister or dimension accuracy (mm) | | | |
| Untreated | 2.495 | 2.495 | 1.004 |
| Nitrided at 580° C. | +0.015 | +0.015 | +0.007 |
| Example 1 | +0.002 | +0.003 | +0.001 |

Nitrided comparative examples of the above SUS316, SUS304 and NCF601 were prepared as follows. The comparative examples were fluorinated for 40 minutes with the same fluorinating gas in the came furnace under the same condition as the above EXAMPLE. Then, after exhausting the fluoride-containing gas from the furnace, nitriding gas (50 vol % $NH_3$, 25 vol % $N_2$ and 25 vol % $H_2$) was introduced therein and the inside was heated up to 580° C., which state had been kept for 3 hours for nitriding.

From the results of the above table 2, it takes a long time for examples to rust in SST than nitrided articles and no change was occurred in examples when being soaked into 15% $HNO_3$, which shows superiority of examples to nitrided articles in corrosion resistance. Furthermore, nitrided articles were magnetized while examples were not magnetized at all. Still furthermore, compared with nitrided articles, blisters were hardly caused, resulting in high dimension accuracy.

EXAMPLE 2

An M6 bolt formed by pressing SUS316 (17 wt % Cr, 13 wt % Ni, 3 wt % MO and the remainder Fe) wire rod, a tapping screw in 4 mm diameter formed by pressing non-magnetic stainless steel (17.8 wt % Cr, 11.5 wt % Ni, 1.4 wt % Mn, 0.5 wt % N and the remainder Fe) wire rod, and an SUS316 plate and an SUS304 plate as same as Example 1, were put into the furnace in FIG. 1, and were heated up to 400° C. and then fluorinated in the same way as Example 1. Next, gas mixture for carburizing (50 vol % CO, 10 vol % $H_2$ and the remainder $N_2$) was introduced into the furnace, which state had been retained for 32 hours for carburizing. In this case, fluorinating and carburizing were almost at the same time. Thus obtained samples were subjected to air blast so that a black layer (1 to 2 μm thickness) on the surface was removed and then the surface hardness was measured. Each hardness of the M6 bolt formed by SUS316, the non-magnetic tapping screw, the SUS316 plate, the SUS304 plate was Hv of 820, 860, 780 and 830 respectively, and each depth of the hard layers were 18 μm, 19 μm, 20 μm and 21 μm, respectively.

Then, thus obtained examples were soaked into 60% solution of 15%$HNO_3$ for 30 minutes so that iron attached thereon was completely removed. And then, the examples were subjected to SST for examining anti-corrosion property. As a result, the SUS316 bolt, the non-magnetic stainless screw, the SUS316 plate did not rust at all over 480 hours. SUS304 plate made a reddish rust slightly in 71 hours. From these results, excellent anti-corrosion property was obtained as same as the above examples.

EXAMPLE 3

An SUS316 plate, an SUS304 plate and an NCF601 plate same as EXAMPLE 1, were put into the same furnace as EXAMPLE 1, and heated up to 400° C., and fluorinated in the same way by introducing the same fluoride-containing gas as used in EXAMPLE 1, and heated up to 480° C., as such a state had been retained, and then carburizing gas (endothermic gas: 30 vol % RX, 2.5 vol % $CO_2$ and 65 vol % $N_2$) was introduced. After such a state had been retained for 12 hours, all examples were withdrawn. Black scale was attached to the surface of thus obtained examples. To remove this black scale, strong acid treatment was conducted. That is, they were soaked into the strong acid (mixture solution of 15 vol % $HNO_3$ and 3 vol % HF) at 50° C. for 10 minutes and were subjected to air blast. As a result, the black scale was removed so that their surface became the same as that of untreated article (in which neither fluorination nor carburizing were conducted) in appearance. On the other hand, samples which were carburized after fluorination without strong acid treatment were prepared for comparison with the above samples with strong acid treatment. Both samples with or without acid treatment were subjected to measurement of surface hardness, depth of hard layer and SST. The results are shown in the following table 3.

TABLE 3

| | 316 BOLT | NON-MAGNETIC TAPPING SCREW | 316 PLATE | 304 PLATE |
|---|---|---|---|---|
| Core hardness (Hv) | 370 | 480 | 240 | 340 |
| Surface hardness (Hv) | | | | |
| after carburizing | 900 | 920 | 870 | 920 |
| after acid treatment | 850 | 870 | 820 | 670 |
| Hard layer | | | | |

TABLE 3-continued

| | 316 BOLT | NON-MAGNETIC TAPPING SCREW | 316 PLATE | 304 PLATE |
|---|---|---|---|---|
| depth (μm) | | | | |
| after carburizing | 28 | 27 | 28 | 27 |
| after acid treatment | 25 | 24 | 25 | 20 |
| Time to rust by SST (h) | | | | |
| after carburizing | 24 | 12 | 26 | 7 |
| after acid treatment | not less than 480 | not less than 480 | not less than 480 | 36 |

From the above table 3, it is found out that anti-corrosion property of samples treated with strong acid was greatly improved than that of untreated ones.

Figure 2A:
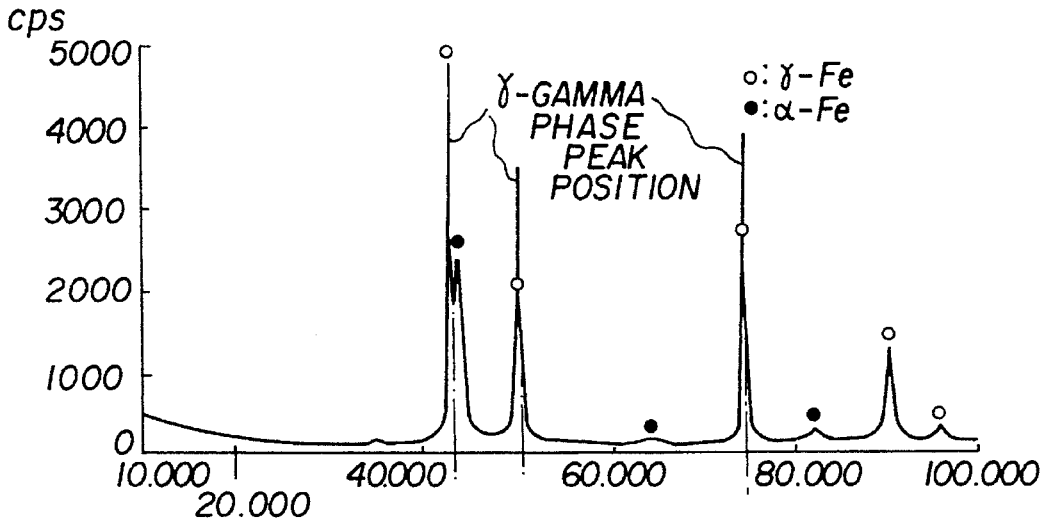
Figure 2B:
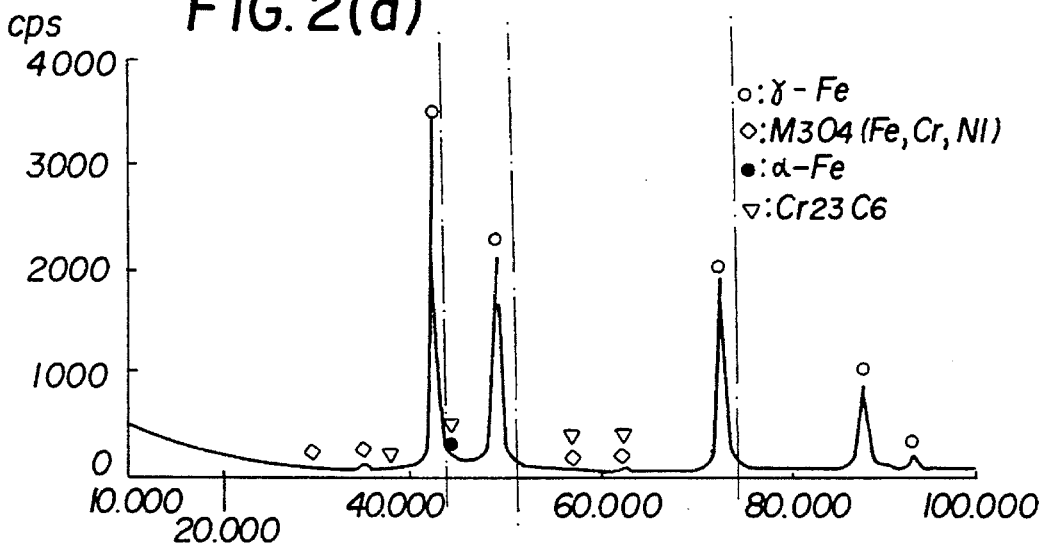
Figure 2C:
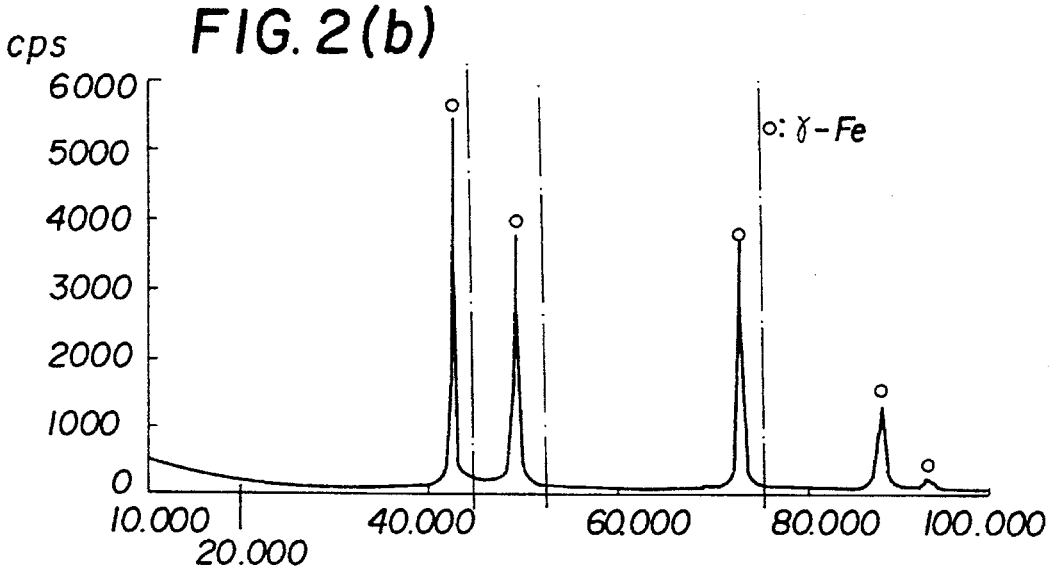

Further, the results of x-ray diffraction on the SUS316 plate treated with strong acid were shown in FIG. 2(*c*), in which Cr carbide was not fixed at all. Furthermore, a peak of γ layer was shifted to a low angle side than that of untreated ones due to lattice distortion caused by much carbon contained in base γ-layer lattice. As a result, hardness was improved.

EXAMPLE 4

An SUS316 plate same as that employed in EXAMPLE 1 was fluorinated in the same way as EXAMPLE 1, and then heated up to 600° C. Subsequently, carburizing gas (50 vol % $N_2$ and 50 vol % RX) was introduced therein and withdrawn after being kept for 4 hours.

Figure 3:
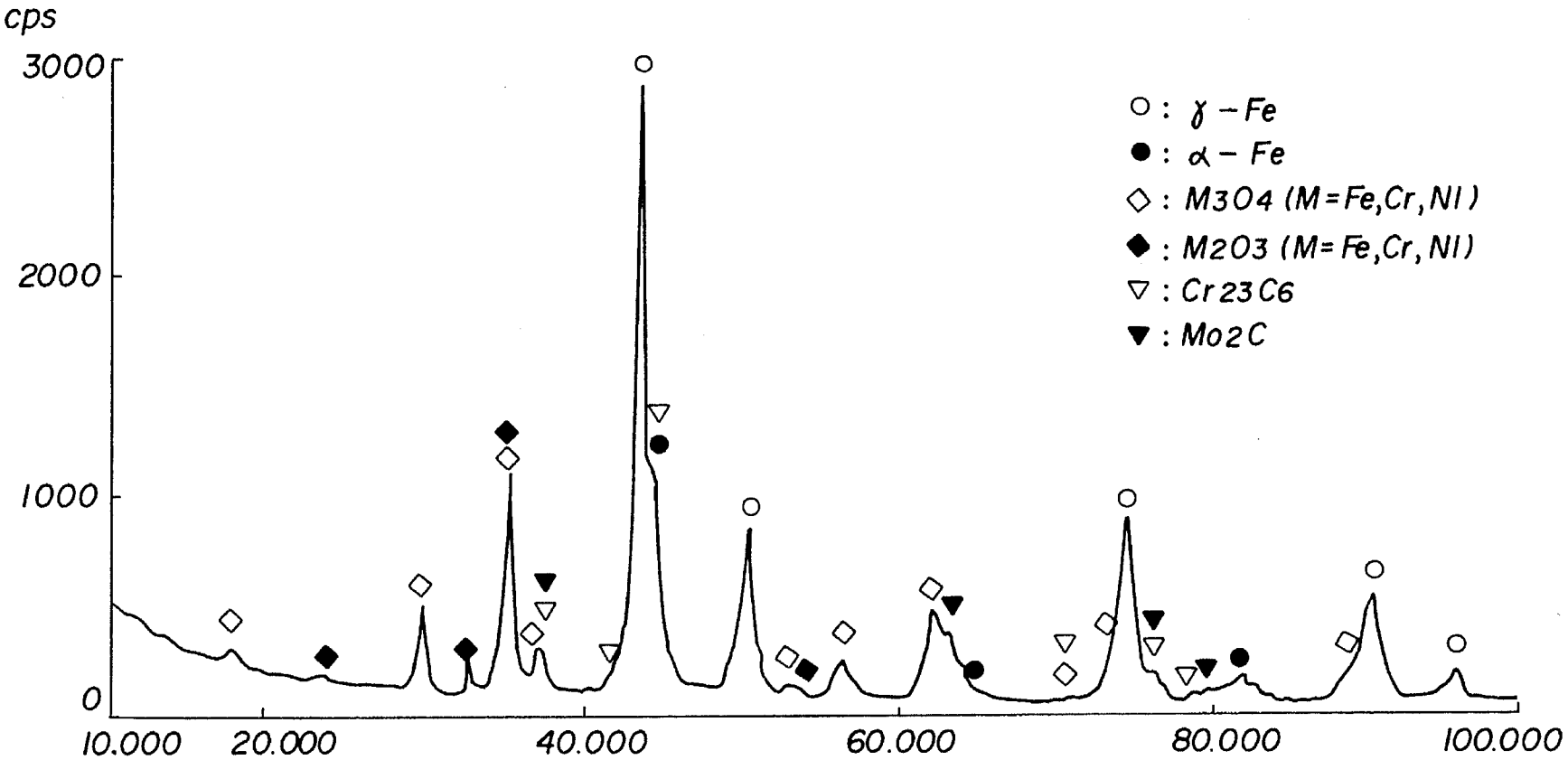
FIG. 3 shows a curve of x-ray diffraction on an SUS316 plate which was carburized at 600° C.

The surface hardness of this example is Hv of 900 and the depth of a hard layer was 35 μm. After the surface was polished, this example was subjected to SST. It took 4 hours to rust, which had a better result than that of nitrided examples, however, it was thought to be not enough as corrosion resestance of stainless steel. The result of x-ray diffraction was shown in FIG. 3, in which a lot of sharp diffraction of Cr carbide and Mo carbide were identified.

EXAMPLE 5

By employing a bolt made of an SUS316 plate and a tapping screw made of non-magnetic stainless steel same as those in EXAMPLE 2 and employing fluorinating gas and carburizing gas same as those in EXAMPLE 3, fluorination and carburizing were conducted simultaneously. In this case, the temperature was set at 510° C. and the time was 8 hours. On the heads of thus obtained screws, surface hardness was Hv of 920 and 980, the depth of the hard layer was 26 μm and 28 μm respectively.

After conducting strong acid treatment same as that of EXAMPLE 3, the surface hardness was measured, resulting in drastic decrease to Hv of 580 and 520 respectively.

Since the carburizing temperature was higher than that of EXAMPLE 3 by 30° C., much chrome carbide deposited on the surface. As a result, parts having poor corrosion resistance were spread and were eroded by strong acid, which is thought to bring about deterioration in surface hardness.

EXAMPLE 6

A plurality of SUS 316 plates (17.5 wt % Cr, 11 wt % Ni and 2 wt % NO) having core hardness same as that conducted with solution treatment, SUS304 plates (0.06 wt % C, 17.5 wt % Cr, 8 wt % Ni and remainder Fe) and M6 bolts formed by pressing SUS316 wire rod were prepared. Among these, a several plates and bolts of each items were put into the furnace in FIG. 1, heated up to 320° C., fluorinated by introducing fluorinating gas (10 vol % $NF_3$ and 90 vol % $N_2$) and withdrawn from the furnace as fluorinated samples.

Subsequently, the remaining items were put into the furnace in FIG. 1 as non-fluorinated samples together with the above fluorinated samples and heated up to 460° C., maintained in that state, and carburized for 12 hours by introducing carburizing gas (20 vol % CO, 75 vol % $H_2$ and 1 vol % $CO_2$).

Among the above samples, fluorinated samples (examples) showed black surface. On the other hand, non-fluorinated samples (comparative examples) showed metallic luster and appearance almost the same as those before treatment. Next, measured surface hardness was each between Hv of 920 and 1050.

In addition, the depth of the hard layer was between 20 μm and 25 μm. On the other hand, no improvement in surface hardness could not be seen in comparative examples; non-fluorinated samples.

COMPARATIVE EXAMPLE 2

The object was an M6 bolt formed by pressing an SUS316 wire rod employed in EXAMPLE 6. The hardness of the head and the screw thread in this bolt reached Hv of 350 to 390 by the above press forming. This bolt was carburized by putting into a normal all case type carburizing furnace of Job Shop (a subcontractor for heat treatment) so as to be carburized at 920° C. for 60 minutes.

As a result, the surface hardness of the carburized bolt reached Hv of 580 to 620 and the depth of the hard layer was 250 μm. However, the hardness of the head and the screw thread drastically decreased to Hv of 230 to 250. Then, this carburized bolt was subjected to SST, resulting in red rust in 6 hours.

EXAMPLE 7

An M4 socket bolt formed by pressing SUS316L, SUS310 (0.06 wt % C, 25 wt % Cr and 20.5 wt % Ni), XM7 (0.01 wt % C, 18.5 wt % Cr, 9.0 wt % Ni and 2.5 wt % Cu), and an M6 bolt made of SUS304 were prepared and each hardness in the head portion was measured. Results were as follows; 340 Hv for the SUS316L bolt, 350 Hv for the SUS310 bolt, 320 Hv for the XM7 bolt and 400 Hv for the SUS304 bolt. Next, these were heated in a furnace shown in FIG. 1 when the atmosphere therein was heated to 350° C. and at that time $N_2$+5 vol$NF_3$ was charged therein for 15 minutes. Then the gas was switched to only $N_2$ and heated to 480° C. Consecutively, carburizing gas composed of 20 vol % $H_2$+10 vol % CO+1 vol % $CO_2$+$N_2$ the remainder was introduced therein so that they were held under such an atmosphere for 15 hours and taken away. All samples assumed black color. After being cleansed, surface hardness and depth of the carburized layer were measured respectively. Results were as follows; 880 Hv and 38 μm in depth for the SUS316, 920 Hv and 30 μm for the SUS310, 890 Hv and 33 μm for the XM7 and 1,080 Hv and 20 μm for the SUS304. Finally, a section of each carburized layer was corroded with aqua regia and examined by a microscope. Results were as follows; both of a hard layer and a non-hard layer in the SUS304 bolt assumed black color, both carburized hard layer of SUS316 and SUS310 bolts assumed white color and bright, and XM7 bolt assumed relatively dark color compared with SUS316 and SUS310 ones.

Next, all of these samples were soaked into 5 wt % HF-20 wt % $HNO_3$ solution at 50° C. for 10 minutes and were taken away. The status of each carburized hard layer after strong acid treatment was as follows; 860 Hv and 35 μm in depth for the SUS316, 880 Hv and 28 μm for the SUS310, 650 Hv and 25 μm for XM7 and 450 Hv and 5 μm for the SUS304. In addition, the SUS316, the SUS310 and the XM7 bolts after acid treatment were subjected to JIS 2371 Salt Spray Test, however, all of them did not rust over 2,000 hours.

EXAMPLE 8

After the same SUS316 socket bolt as employed in example 1 was fluorinated in the same way as that of example 1, it was hold under an atmosphere composed of 20 vol % $H_3$+10 vol % CO+1 vol % $CO_2$+$N_2$ the remainder at 50° C. for 12 hours and then withdrawn. The surface hardness of the head portion was 1,020 Hv and the depth of the carburized layer was 45 μm. Next, it was soaked into 5 wt % HF-28 wt % $HNO_3$ solution for 10 hours and then withdrawn. Being examined, the hardness was 650 Hv and the depth was 20 μm, which were decreased compared with those before acid treatment. This means that it was etched by HF-$HNO_3$ solution.

EXAMPLE 9

A drill tapping screw (having neck portion of 25 mm length) was formed by pressing an SUS316L wire rod containing 2 wt % Cu. This was carburized in the same way as example 1 except that a temperature was 490° C. and the time was 16 hours as the carburizing condition. After being carburized, it was soaked into 3 wt %HF-15 wt %$HNO_3$ solution at 55° C. for 15 hours and then subjected to shot blast. Being examined after the shot blast, the surface hardness was 890 Hv and the depth was 42 μm. Secondly, 213t of SPCC was prepared. Being subjected to a drilling test with a hand driver, approximately the same drilling property as carburized iron products was obtained.

EXAMPLE 10

The same 316L socket bolt and 310 bolt as employed in example 1 were fluorinated in the same way as that of example 1. Consecutively, they were heated to 430° C. and hold in the same carburizing gas for 24 hours and then taken away. The surface hardness at that time was 720 Hv for the 316 and 780 Hv for the 310, while the thickness of the hard layer was 21 μm for the 316 and 16 μm for the 310 respectively.

What is claimed is:

1. A method of carburizing austenitic metal comprising the steps of holding austenitic metal in a fluoride-containing gas atmosphere with heating prior to carburizing and carburizing the austenitic metal at a temperature not more than 680° C.

2. A method of carburizing austenitic metal according to claim 1, wherein the carburizing temperature is set within a range of 400° to 500° C.

3. A method of carburizing austenitic metal according to claim 1 or 2, wherein the temperature in fluoride-containing gas atmosphere in the pre-treatment step is set within a range of 250° to 450° C.

4. A method of carburizing austenitic metal according to any of claims 1 or 2, wherein austenitic metal is austenitic stainless steel.

5. A method of carburizing austenitic metal according to any of claims 1 or 2, wherein austenitic metal is Ni base alloy containing 32% by volume nickel.

6. A method of carburizing austenitic metal according to claim 3, wherein austenitic metal is austenitic stainless steel.

7. A method of carburizing austenitic metal according to claim 3, wherein austenitic metal is Ni base alloy containing 32% by volume nickel.

8. A method of carburizing austenitic metal according to claim 4, wherein austenitic metal is Ni base alloy containing 32% by volume nickel.

* * * * *

UNITED STATES PATENT AND TRADEMARK OFFICE

CERTIFICATE OF CORRECTION

PATENT NO.: 5,593,510
DATED : January 14, 1997
INVENTOR(S): Masaaki TAHARA et al

It is certified that error appears in the above-identified patent and that said Letters Patent is hereby corrected as shown below:

Column 14, claim 5, line 39, change "volume" to --weight--.

Column 14, claim 7, line 44, change "volume" to --weight--.

Column 14, claim 8, line 47, change "volume" to --weight--.

Signed and Sealed this

Twenty-ninth Day of December, 1998

*Attest:*

Bruce Lehman

BRUCE LEHMAN

*Attesting Officer*

*Commissioner of Patents and Trademarks*